US007018138B2

(12) United States Patent
Bae

(10) Patent No.: US 7,018,138 B2
(45) Date of Patent: Mar. 28, 2006

(54) PIER-REPAIRING AND REINFORCING PANEL AND METHOD OF REPAIRING AND REINFORCING PIERS USING SUCH PANELS

(76) Inventor: Suk-Dong Bae, 129-404ho. Slyoung A.P.T., Sinchen-Dong, Songpa-ku, 138-796, Seoul (KR)

( * ) Notice: Subject to any disclaimer, the term of this patent is extended or adjusted under 35 U.S.C. 154(b) by 0 days.

(21) Appl. No.: 10/485,946

(22) PCT Filed: Aug. 7, 2002

(86) PCT No.: PCT/KR02/01504

§ 371 (c)(1),
(2), (4) Date: Feb. 6, 2004

(87) PCT Pub. No.: WO03/014475

PCT Pub. Date: Feb. 20, 2003

(65) Prior Publication Data

US 2004/0202511 A1 Oct. 14, 2004

(30) Foreign Application Priority Data

Aug. 7, 2001 (KR) ..... 2001-47428

(51) Int. Cl.
*E02D 7/00* (2006.01)
*E02D 13/00* (2006.01)

(52) U.S. Cl. ..... 405/249; 405/136; 405/151; 405/153; 405/232; 405/233; 405/257; 249/48; 249/209; 52/745.18

(58) Field of Classification Search ..... 405/151–153, 405/231–233, 134–136, 249, 257; 52/169.13, 52/169.9, 745.18, 745.17; 249/48, 49, 34, 249/209, 219.1
See application file for complete search history.

(56) References Cited

U.S. PATENT DOCUMENTS 413,384 A * 10/1889 Beecher ..... 405/137
1,552,334 A * 9/1925 Mosher ..... 249/194
1,947,413 A * 3/1934 Hay ..... 249/48
3,695,044 A * 10/1972 Hoshino et al. ..... 405/153
3,707,846 A * 1/1973 Leblond et al. ..... 405/152
3,816,154 A * 6/1974 Baldyga et al. ..... 106/482
3,946,567 A * 3/1976 Oger ..... 405/153
5,032,197 A * 7/1991 Trimble ..... 156/71
5,044,601 A * 9/1991 Miller ..... 249/219.1
5,255,888 A * 10/1993 Workman ..... 249/48
6,419,204 B1 * 7/2002 Flathau ..... 249/48
2002/0170264 A1 * 11/2002 Koszo ..... 249/48

FOREIGN PATENT DOCUMENTS

| | | | |
|---|---|---|---|
| GB | 2167796 | * | 6/1986 |
| JP | 51136327 | | 11/1976 |
| JP | 06146232 | * | 5/1994 |
| JP | 7259334 | | 10/1995 |
| JP | 11200369 | * | 7/1999 |
| KR | 2000012299 | | 3/2000 |
| KR | 2001054812 | * | 7/2001 |
| KR | 2001099341 | * | 11/2001 |
| KR | 2003006236 | * | 1/2003 |

* cited by examiner

*Primary Examiner*—Jong-Suk (James) Lee
(74) *Attorney, Agent, or Firm*—Kramer & Amado, P.C.

(57) ABSTRACT

A pier-repairing and reinforcing panel is used in a method of repairing and reinforcing a pier. The panel includes locking members, locking ribs, reinforcing ribs, and clips. The method includes the steps of: installing a watertight caisson around a pier and removing water from the gap between the caisson and pier. Impurities are removed from the pier's surface, and a plurality of panels are installed around the pier while sealing the junctions of the panels. A plurality of reinforcing steel bars are arrayed in the gap between the pier and panels, and the panels are then affixed to the steel bars or the pier using anchor bolts. The gap between the pier and the panels are then filled with concrete. The pier is effectively repaired and reinforced while separating the reinforced concrete from water, thus protecting the concrete and steel bars for a desired lengthy period of time.

2 Claims, 9 Drawing Sheets

PIER-REPAIRING AND REINFORCING PANEL AND METHOD OF REPAIRING AND REINFORCING PIERS USING SUCH PANELS

BACKGROUND OF THE INVENTION

1. Field of the Invention

The present invention relates to a pier-repairing and reinforcing panel and a method of repairing and reinforcing a pier using such panels. The pier-repairing and reinforcing panel is installed in the edge of outside, the combining member having combining holes inserted by a bolt, locking ribs which has a plurality of locking holes formed in the edge of inside, reinforcing ribs formed inside of locking ribs, clips with locking projection at one-side to insert into locking hole. The method of repairing and reinforcing a pier comprises the process of: installing watertight caisson around a pier; removing water from the gap between the caisson and pier, eliminating impurities from the pier's surface, and installing a plurality of panels around the pier while sealing the junctions of the panels, arraying a plurality of reinforcing steel bars in the gap between the pier and panels, fixing the panels to the steel bars or the pier using anchor bolts, and filling the gap between the pier and the panels with concrete.

2. Description of the Prior Art

In general, a pier should be repaired or reinforced immediately when the strength of covered concrete weakened by freezing or melting, corrosion of the steel bar occurs due to the separation of material and lack of the covering, abrasion and erosion by collision with conveying material and whirlpool, and also neutralization of concrete has been founded.

As shown in FIG. 1, the method of repairing and reinforcing piers is that installing Blast tank (106) and a caisson (106) equipped with a watertight tube (105) around the pier (100), removing water from the gap between the caisson (101) and the pier (100), a worker (102) comes down through the wire (103) to repair and reinforce it.

However, the prior art for repairing and reinforcing the said pier has still some disadvantages such as spots resulting from partial repairing of the pier (100), partial separation or erosion by the lack of adhesiveness with a concrete, and still the repaired pier (100) immersed in the water after repairing.

DISCLOSURE OF THE INVENTION

To solve the problems of the prior art as described above, It is an object of the present invention to provide a pier-repairing and reinforcing panel and a method of repairing and reinforcing a pier using such panels which can repair not part of the pier but the entire pier and keep the concrete away from water after repairing.

The present invention is achieved by following materials to fix a pier. The pier-repairing and reinforcing panel is installed in the edge of outside, combining member having combining holes inserted by a bolt, locking ribs which has a plurality of locking holes formed in the edge of inside, reinforcing ribs formed inside of locking ribs, clips with combining projection at one-side to insert into combining holes. And the method of repairing and reinforcing a pier comprise the steps of: installing water tight caisson around the pier, removing water from the gap between the caisson and the pier, removing impurities from the pier's surface, and installing a plurality of panels around the pier while sealing the junctions of the panels, arraying a plurality of reinforcing steel bars in the gap between the pier and panels, fixing the panels to the steel bars or the pier using anchor bolts, and filling the gap between the pier and the panels with concrete.

Therefore, the present invention effectively repairs and reinforces the entire piers while covering the reinforced concrete from water, thus no further aging, abrasion, cracking and separation of the concrete and corrosion of steel bars occurs.

DESCRIPTION OF THE REFERENCE NUMERALS IN THE DRAWINGS

| | | |
|---|---|---|
| 10: panel | 11: combining member | 12: combining hole |
| 13: locking rib | 14: clip | 15: locking projection |
| 16: locking hole | 17: reinforcing rib | 18: anchor bolt |
| 19: airtight nut | 20: steel bar | 21: pier |

BEST MODE FOR CARRYING OUT THE INVENTION

The compositions and functions of the present invention are described with the drawings in detail.

Figure 1:
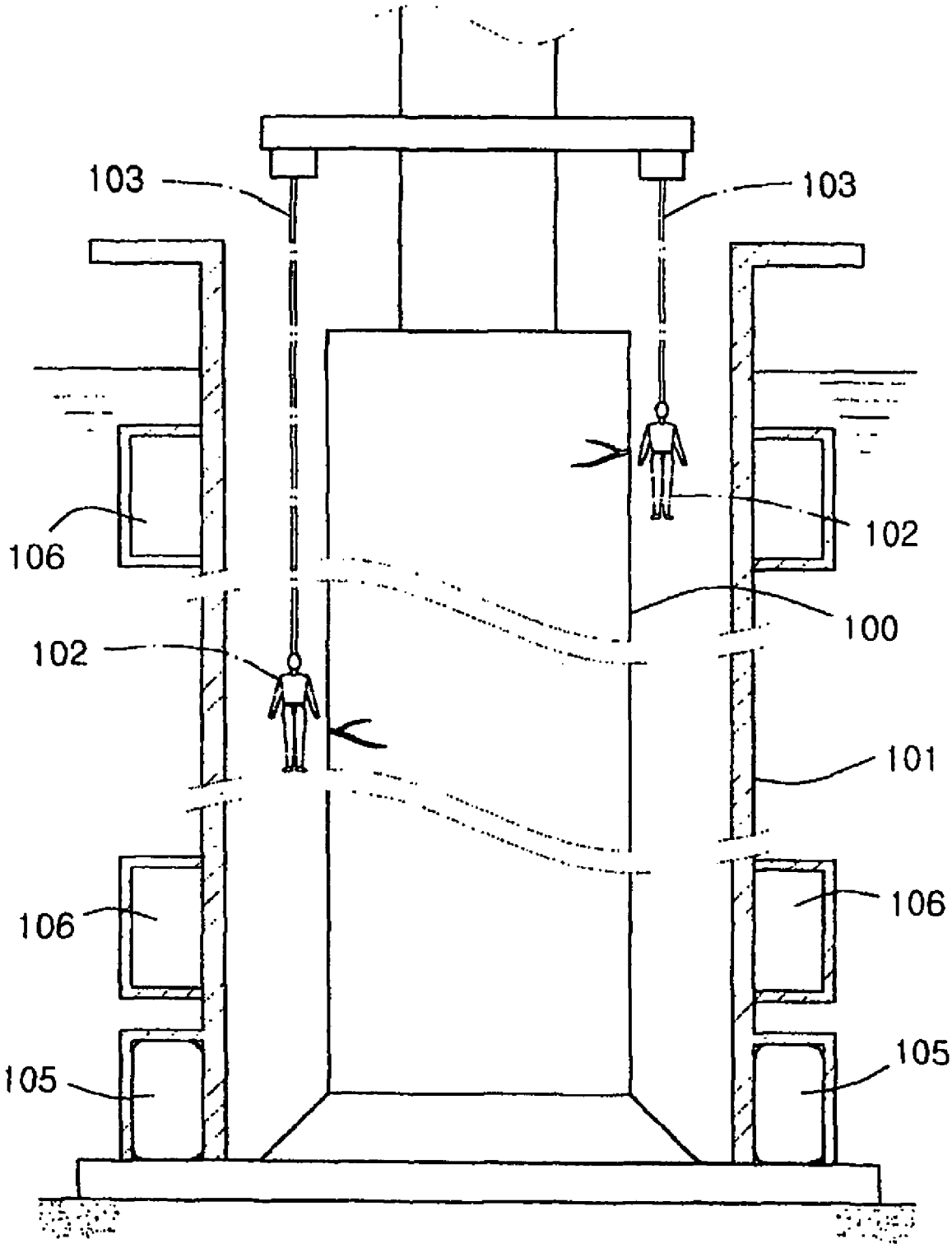
FIG. 1 is a configuration of the prior art of repairing and reinforcing of the pier.
Figure 2:
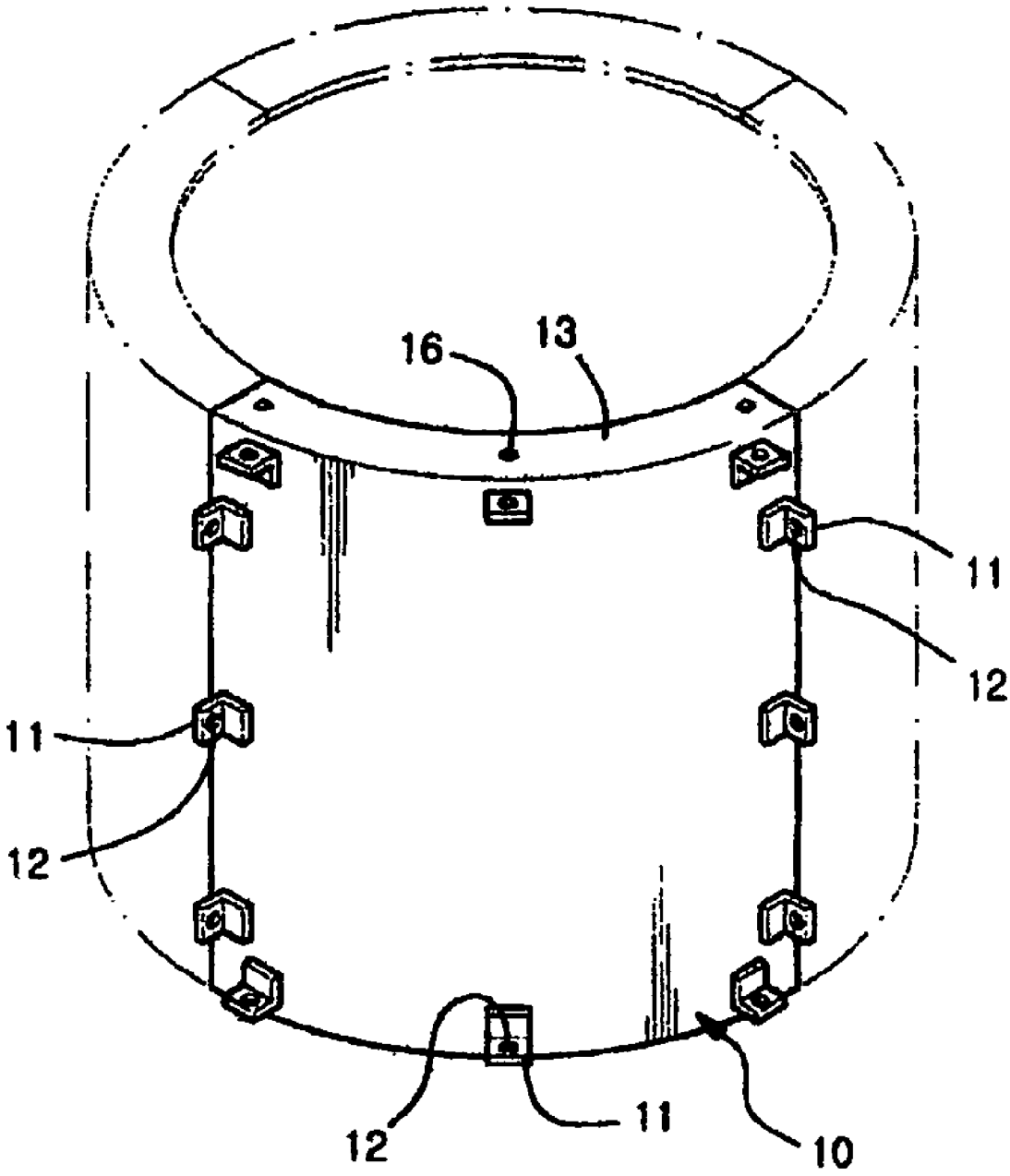
FIG. 2 is a perspective view of outside panel of the present invention.

FIG. 2 is a perspective view of outside panel of the present invention.

Figure 3:
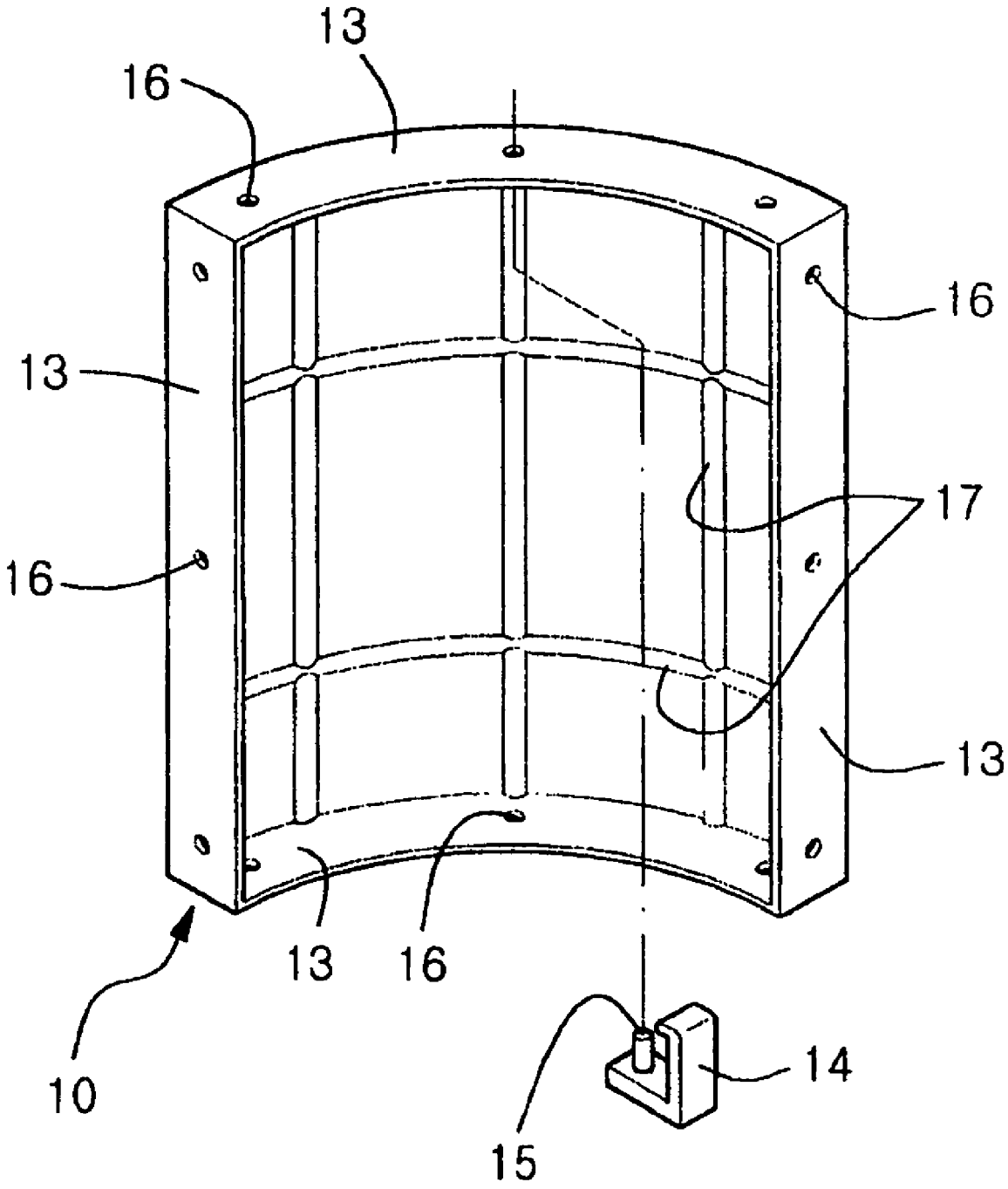
FIG. 3 is a perspective view of inside panel of the present invention.

FIG. 3 is a perspective view of inside panel of the present invention.

Figure 4:
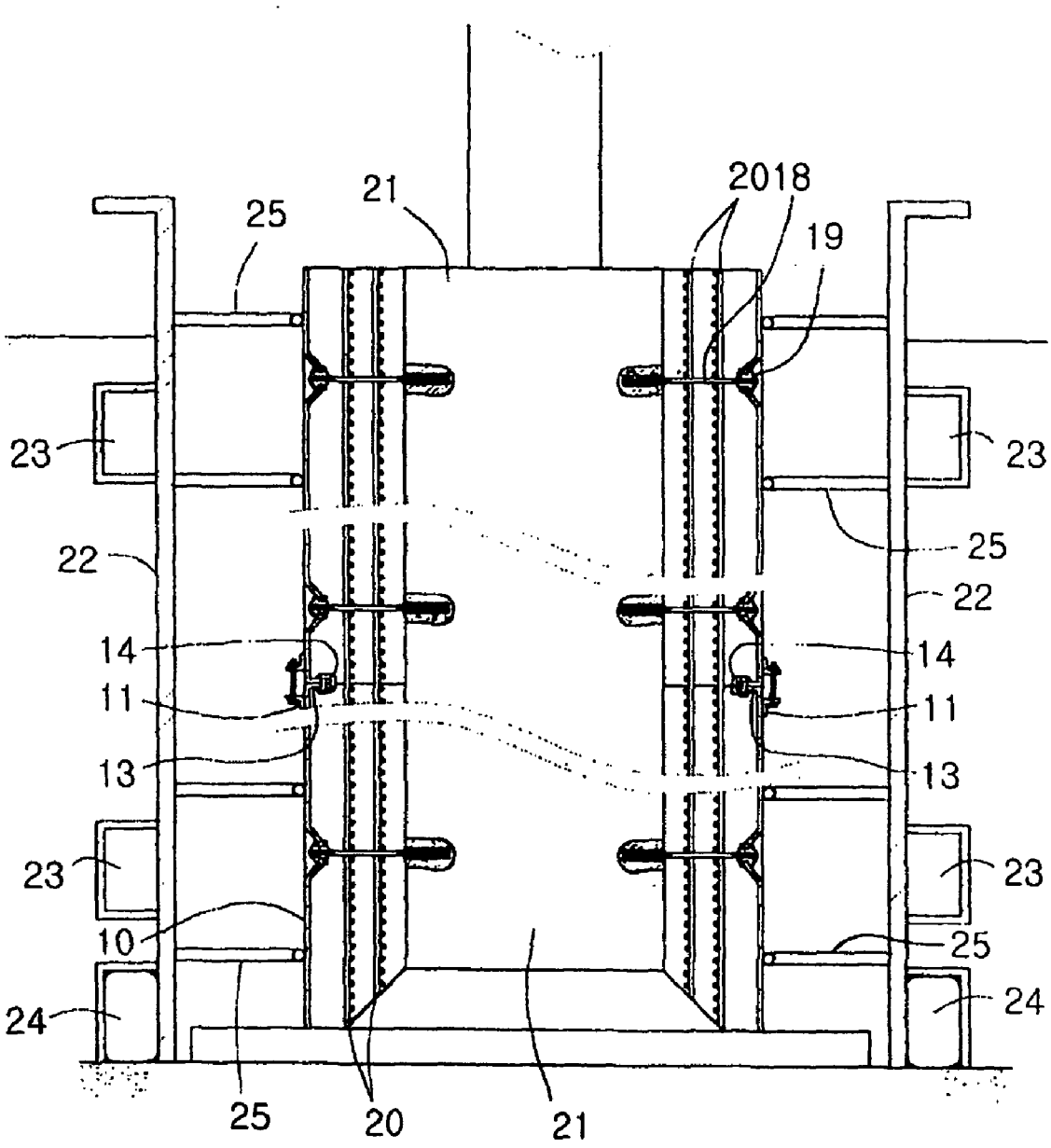
FIG. 4 is a configuration showing the panel-installed state followed the present invention.

FIG. 4 is a configuration showing the panel-installed state followed the present invention.

Figure 5:
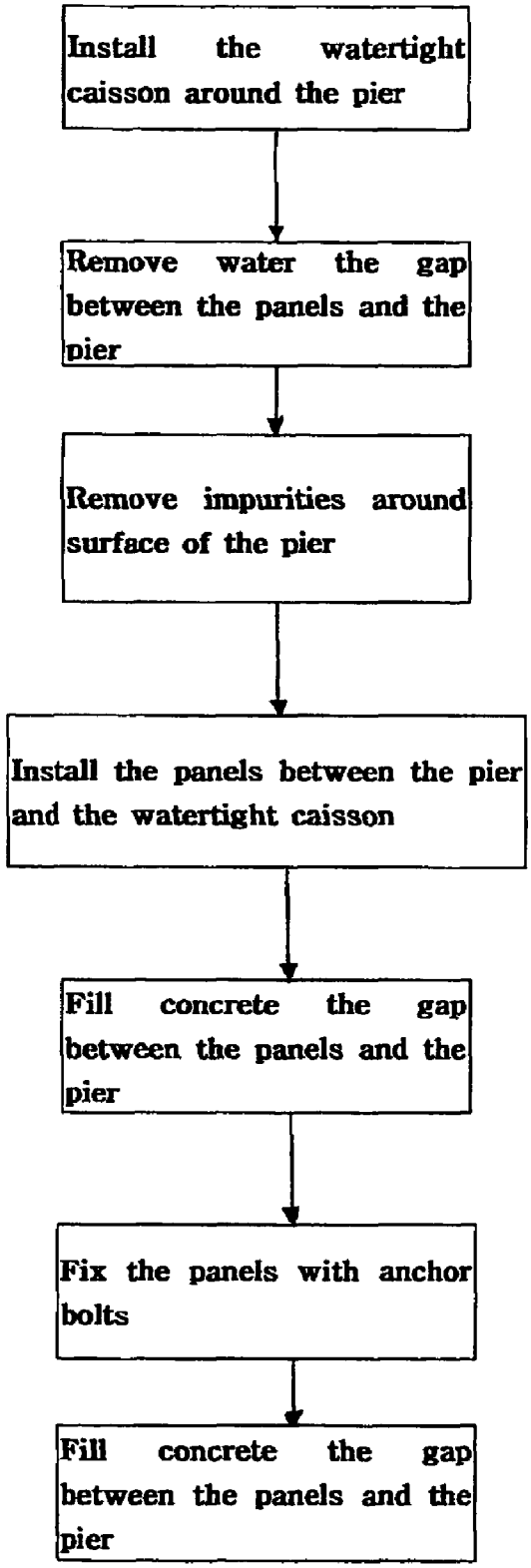
FIG. 5 is a configuration showing the process for repairing and reinforcing in the present invention.

FIG. 5 is a configuration showing the process for repairing and reinforcing in the present invention.

Figure 6A:
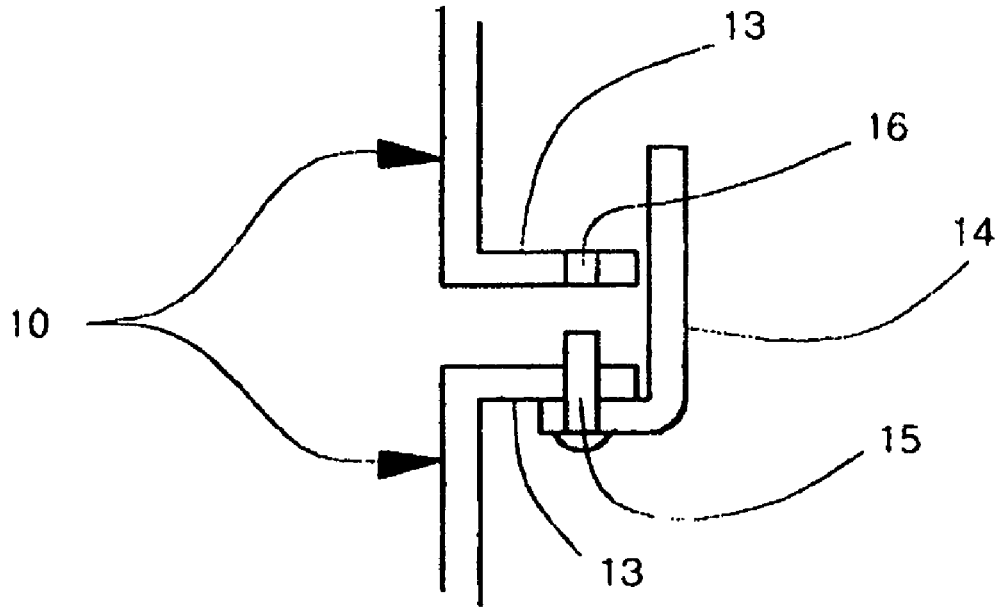
FIG. 6*a* to FIG. 6*c* are configurations showing a process how to combine panels with clips in the present invention.
Figure 6B:
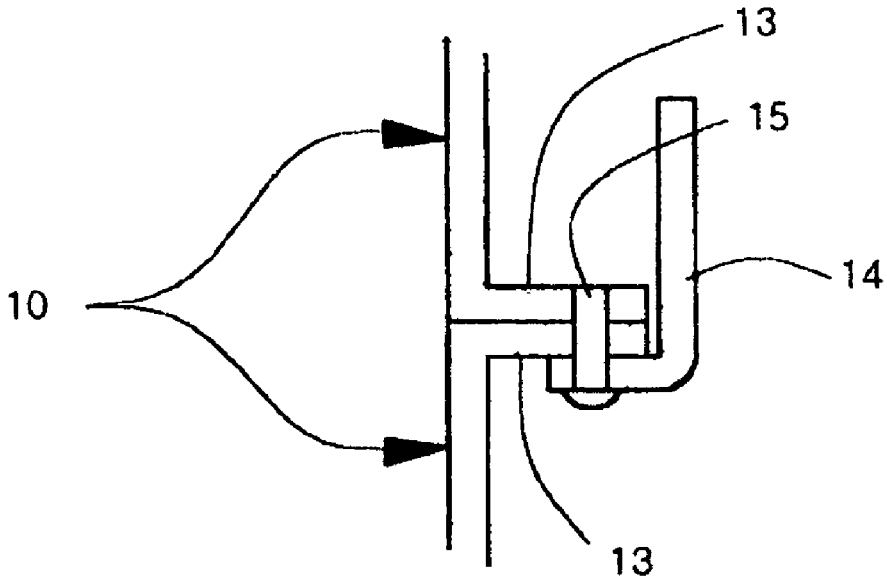
Figure 6C:
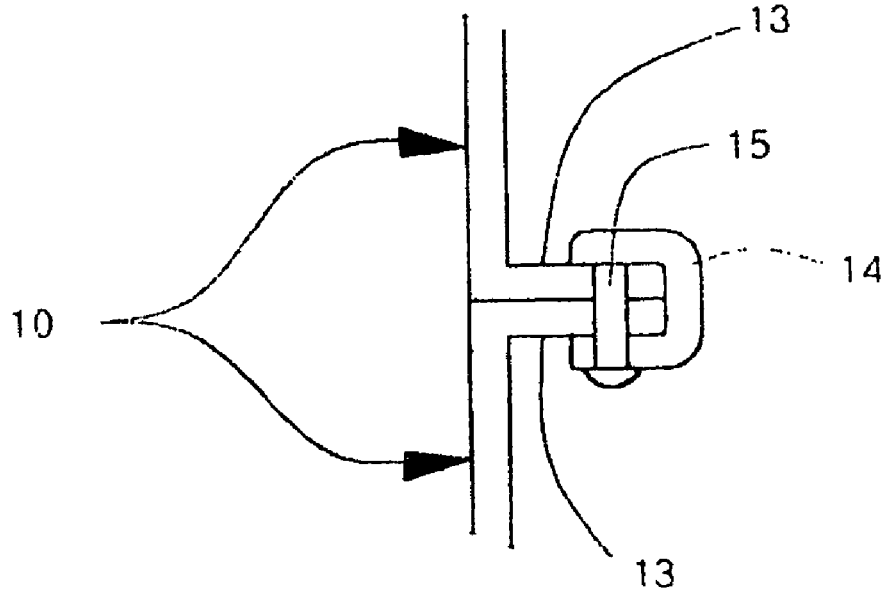

FIG. 6*a* to FIG. 6*c* are configurations showing a process how to combine panels with clips in the present invention.

Figure 7:
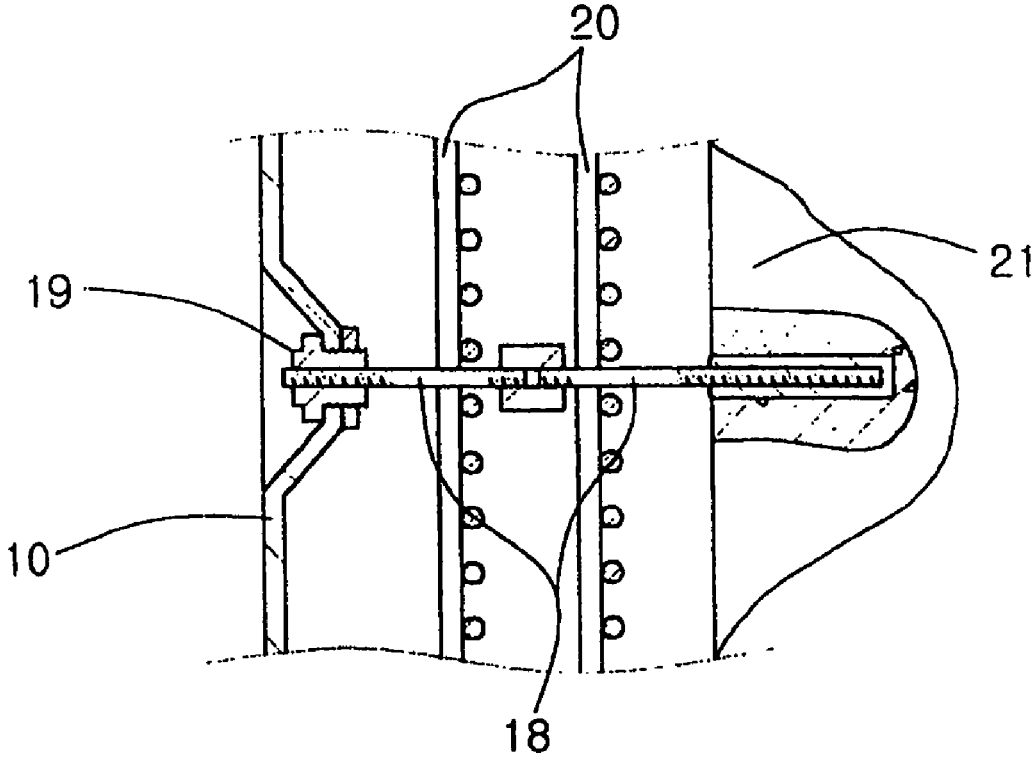
FIG. 7 is a configuration describing how to fix panels to the piers in the present invention.

FIG. 7 is a configuration describing how to fix panels to the piers in the present invention.

As show in drawings, a plurality of combining member (11), having combining holes (12) to be inserted with a bolt, are formed, and locking rib (13) having locking hole (16) inside end of the said panel (10).

A plurality of reinforced rib (17) inside of locking rib (13), locking projection (15) to fit locking hole (16) in one side and is bended in other side and a clip (14) to combine a panel (10) are formed.

The method of repairing and reinforcing a pier (21) with a panel (10) of present invention: installing a watertight caisson (22), having a Blast tank (23) and watertight tube (24) around the pier (21), removing water from the gap between the caisson (22) and pier (21), removing impurities from the pier (21)'s surface, and installing a plurality of panels (10) around the pier while sealing the junctions of the panels, removing water from the gap between panel (10) and pier (21), arraying a plurality of reinforcing steel bars (20) in the gap between the pier (21) and panels (10), fixing the panels (10) to the steel bars (20) or the pier (21) using anchor bolts (18), and filling the gap between the pier (21) and the panels (10) with concrete.

It can be described in detail as below: installing watertight caisson (22) comprising with a support (25) and watertight tube (24), Blast tank (23) around a pier (21), removing water from the gap between the caisson (22) and the pier (21), removing impurities from the pier (21)'s surface, and installing a plurality of panels (10), which are higher and wider than the pier (21)'s around the pier (21), while sealing the junctions of the panel (10) with an airtight stuff for waterproof, fixing a bolt to pass through combining hole (12) of combining member (11) and then locking with the combining hole (12) of another panel (10) with a nut for the outside of panel (10) and insert locking projection (15) of a clip (14) into the locking hole (16) and then inserting into the locking hole (16) of locking rib (13) of neighboring panel (10) for inside of panel as FIG. 6*a* to 6*c*, knocking the end of a clip (14) to fix two neighboring locking ribs (13).

After that, completely removing water from the gap between fixed panel (10) and the pier (21) and fixing the steel bars in that place, installing the airtight nut (19) after making a hole in a proper position of jointed panels (10), locking anchor bolt (18) into airtight nut (19) while inserting and locking the end of anchor bolt (18) with a pier (21), filling a special chemical to the place where anchor bolt (18) and pier (21) meet, to stick strongly together.

Figure 8:
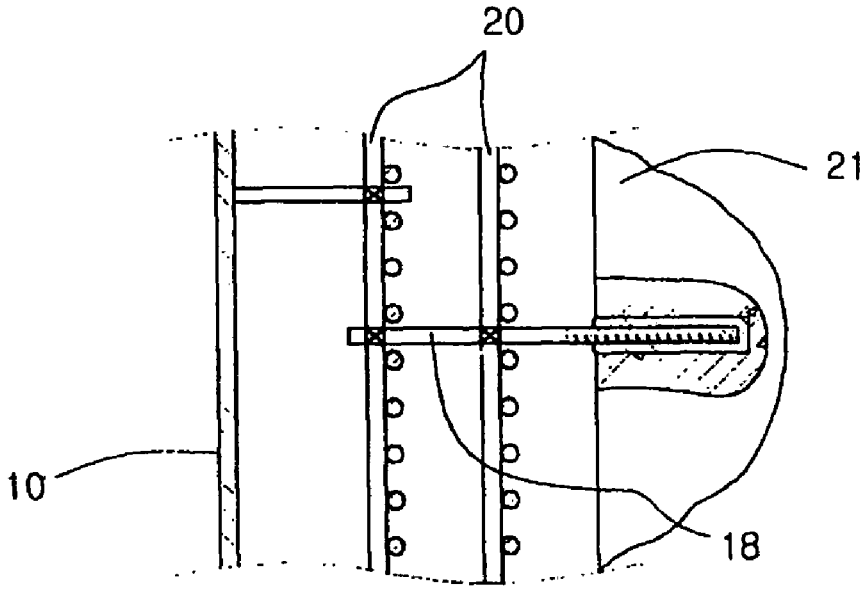
FIG. 8 to FIG. 10 are configurations showing another examples to fix panels.
Figure 9:
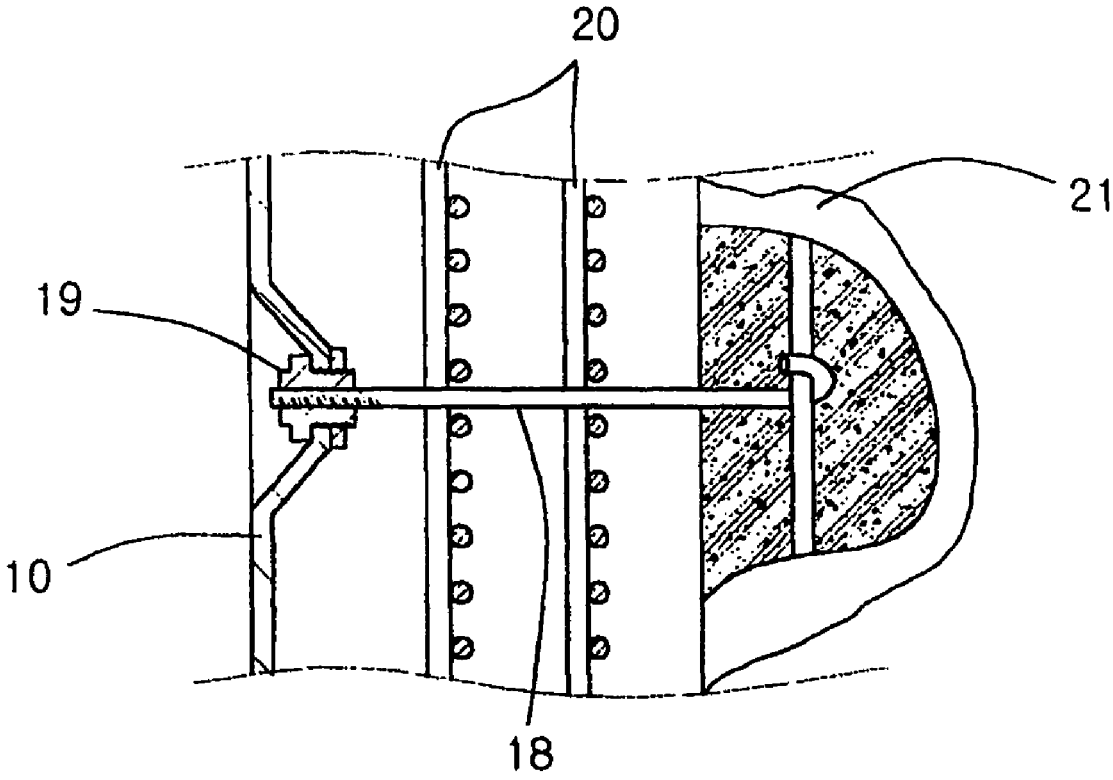
Figure 10:
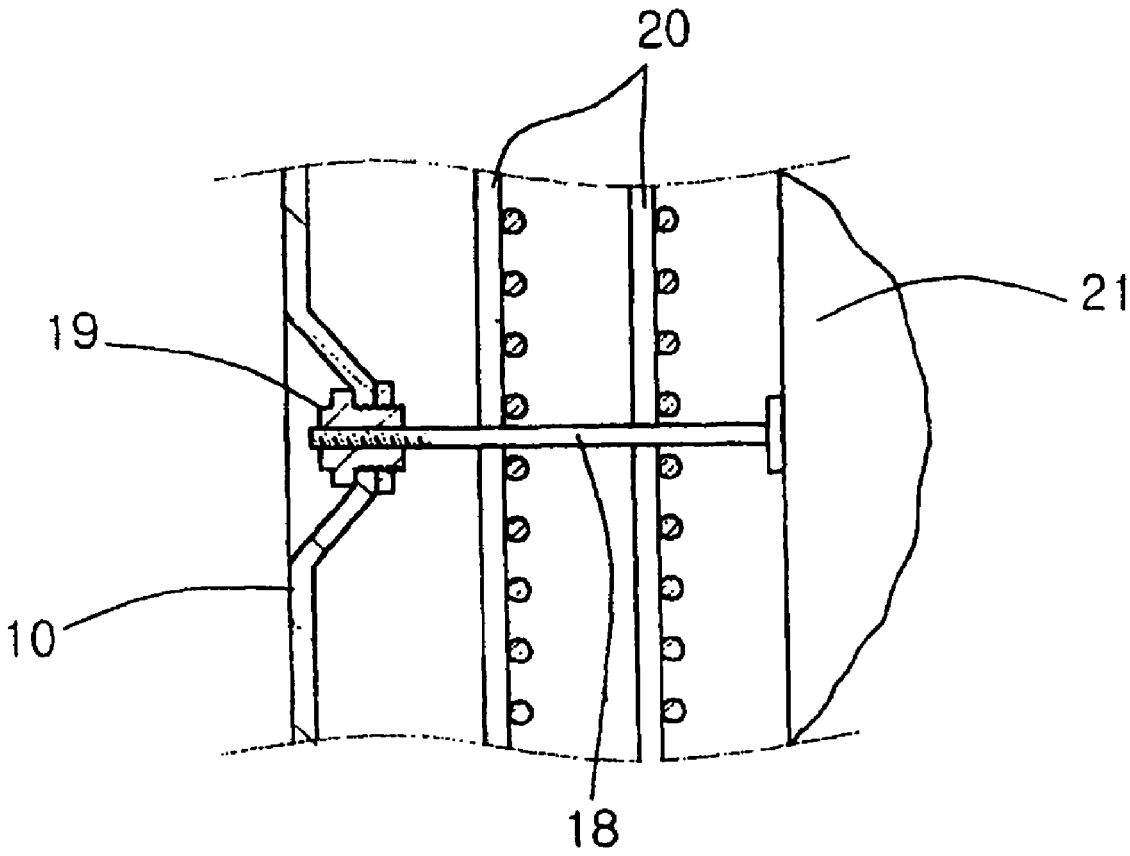

As shown in FIG. 8 to 10, another way to fix panels (10) is that one side of anchor is inserted into the pier (21) and the other side of anchor is welded with a steer bar (20), ends of another bolt (18) can be welded and fixed with panel (10) and steel bar (20). The chain in an end of anchor bolt (18), can be hung and fix into the naked steel bar from the pier (21) and panels (20) can be fixed with the force sticked to the surface of pier (21) by the end of anchor bolt (18).

After that, filling the gap between the panels (10) and the pier (21) with concrete until the concrete is dried and finally eliminating the watertight caisson (22).

The present invention repairs and reinforces not partially but fully the entire piers (21), thus protecting the concrete and steel bars from the cracking or other new problems for a desired lengthy period of time.

INDUSTRIAL APPLICABILITY

As mentioned above, the present invention provide's a method of repairing and reinforcing a pier using such panels. Due to protecting the concrete from the exposure in the present invention, aging, abrasion, and falling of the concrete can not occur. Additionally, By repairing and reinforcing entire piers, we can protect the concrete and steel bars from the cracking or other new problems for a desired lengthy period of time.

The invention claimed is:

1. A method of repairing and reinforcing a pier using a plurality of panels, wherein each panel has a combining member with an outside edge defining a combining hole for insertion by a bolt, locking ribs each defining a plurality of locking holes in an inside edge thereof, reinforcing ribs formed inside of the locking ribs, and clips each defining a projection at one-side for insertion into a corresponding locking hole during installation of each panel around the pier, to thereby repair and reinforce the pier, comprising the steps of:

installing a watertight caisson around the pier; removing water from a gap between the caisson and the pier, removing impurities from a surface of the pier, and fixing a plurality of panels around the pier to the height of the pier while sealing junctions of the panels; arraying a plurality of reinforcing steel bars in the gap between the pier and the panels; and fixing the panels to the steel bars or the pier using anchor bolts, and filling the gap between the pier and the panels with concrete.

2. A method of repairing and reinforcing a pier using panels, comprising:

installing a watertight caisson around the pier;

removing water from a gap between the caisson and the pier, removing impurities from a surface of the pier;

fixing a plurality of the panels around the pier to the height of the pier while sealing junctions of the panels;

arraying a plurality of reinforcing steel bars in the gap between the pier and the panels;

fixing the panels to the steel bars or the pier using anchor bolts; and filling gaps between the pier and the panels with concrete after sealing the junctions of the panels.

* * * * *